US006705482B2

(12) United States Patent
Savitz et al.

(10) Patent No.: US 6,705,482 B2
(45) Date of Patent: Mar. 16, 2004

(54) BALL AND SOCKET CLOSURE

(76) Inventors: Steven Robert Savitz, 1300 Alicia Ave., Teaneck, NJ (US) 07666; Gary S. Grant, 36911 N. Terry Dr. East, Lake Villa, IL (US) 60046

( * ) Notice: Subject to any disclaimer, the term of this patent is extended or adjusted under 35 U.S.C. 154(b) by 130 days.

(21) Appl. No.: 09/944,329

(22) Filed: Aug. 31, 2001

(65) Prior Publication Data

US 2002/0023892 A1 Feb. 28, 2002

(Under 37 CFR 1.47)

Related U.S. Application Data

(63) Continuation of application No. 08/681,034, filed on Jul. 22, 1996, now abandoned.

(51) Int. Cl.[7] ..... B65D 51/18

(52) U.S. Cl. ..... 220/254.3; 215/312; 222/507; 222/554; 222/536; 422/99

(58) Field of Search ..... 215/311–313, 303, 215/305, 317, 320, 354, 355; 220/253, 254.3; 222/507, 548, 553, 554, 560, 531, 536; 435/297.5, 299.2, 305.3, 305.4; 422/99, 102; 404/167, 169, 236, 256, 905

(56) References Cited

U.S. PATENT DOCUMENTS

| | | | |
|---|---|---|---|
| 1,430,313 | A | 9/1922 | Millity |
| 1,691,811 | A | 11/1928 | Johnson |
| 1,726,642 | A | 9/1929 | Betts |
| 1,747,550 | A | 2/1930 | Klimburg |
| 1,882,180 | A | 10/1932 | Davidson et al. |
| 2,030,696 | A | 2/1936 | Forster |
| 2,032,776 | A | 3/1936 | Van Ness |
| 2,120,510 | A | 6/1938 | Rhoads |
| 2,126,814 | A | 8/1938 | Rest |
| 2,127,465 | A | 8/1938 | Church |
| 2,135,848 | A | 11/1938 | Sandstrom |
| 2,209,050 | A | 7/1940 | Church |

(List continued on next page.)

FOREIGN PATENT DOCUMENTS

| | | |
|---|---|---|
| DE | 34 00 660 A1 | 7/1985 |
| DE | 43 37 627 C1 | 3/1995 |
| EP | 0487 448 A1 | 5/1992 |
| EP | 0 622 623 A2 | 2/1994 |
| GB | 448119 | 6/1936 |
| GB | 463118 | 3/1937 |
| GB | 479200 | 2/1938 |
| IT | 447478 | 4/1949 |
| IT | 539850 | 2/1956 |
| IT | 569611 | 11/1957 |
| JP | 5-170256 | 7/1993 |

*Primary Examiner*—Nathan J. Newhouse
(74) *Attorney, Agent, or Firm*—Hoffmann & Baron, LLP

(57) ABSTRACT

A closure for sealing the open end of body fluid collection, transport or storage containers or tubes. The closure includes a ball and socket arrangement, wherein the ball rotates within the socket to align a passageway through the ball with the opening in the tube. To close the closure, a tab or protrusion extending from the ball is pushed to rotate the ball and orient the passageway perpendicular to the opening of the tube. When the closure is in the closed position, the ball and socket form a liquid tight seal to prevent liquid in the tube from leaking out of the tube, evaporating or being contaminated.

2 Claims, 6 Drawing Sheets

U.S. PATENT DOCUMENTS

| | | | | | |
|---|---|---|---|---|---|
| 2,558,671 | A | | 6/1951 | Cherry | |
| 2,749,566 | A | | 6/1956 | Thomas | |
| 2,779,519 | A | | 1/1957 | Rossetti | |
| 2,790,583 | A | * | 4/1957 | Kolenda | 222/554 |
| 2,805,801 | A | | 9/1957 | Jacobs et al. | |
| 2,885,128 | A | | 5/1959 | Zimmerli | |
| 2,990,980 | A | | 7/1961 | Gronemeyer | |
| 3,362,556 | A | * | 1/1968 | Waldrum | 215/355 |
| 3,702,165 | A | | 11/1972 | Carow et al. | |
| 3,703,249 | A | | 11/1972 | Middleton | |
| 3,703,250 | A | | 11/1972 | Middleton | |
| 3,782,608 | A | | 1/1974 | Schneider | |
| 3,898,046 | A | | 8/1975 | Ikeda et al. | |
| 4,181,246 | A | | 1/1980 | Norris | |
| 4,390,111 | A | | 6/1983 | Robbins et al. | |
| 4,394,944 | A | | 7/1983 | Rech | |
| 4,515,752 | A | | 5/1985 | Miramanda | |
| 5,225,165 | A | | 7/1993 | Perlman | |
| 5,433,716 | A | | 7/1995 | Leopardi et al. | |

* cited by examiner

BALL AND SOCKET CLOSURE

CROSS-REFERENCE TO RELATED APPLICATIONS

This application is a continuation of U.S. patent application Ser. No. 08/681,034, filed on Jul. 22, 1996 now abandoned.

BACKGROUND OF THE INVENTION

1. Field of the Invention

The present invention relates to a closure for body fluid collection, transport or storage containers and, more particularly, relates to a ball and socket closure to be used to resealably close a container being used in a laboratory or other clinical environment.

2. Background Description

After a doctor, phiebotomist or nurse has used an evacuated blood collection tube or other primary tube to draw a primary sample of body fluid from a patient in a hospital or doctor's office, the primary sample will typically be "poured off" or pipetted into a secondary tube so that the sample can be simultaneously tested in two or more different areas of a clinical chemistry laboratory. For example, the sample may undergo routine chemistry, hormone, immunoassay, or special chemistry testing. In addition, the sample is sometimes "poured off or pipetted" into a secondary tube for overnight storage, to transport the sample from one laboratory to another, or to remove the plasma or serum sample from a separator gel or red blood cells used in the primary tube. When the secondary tube is not being used or is being transported, it is very important to close the open end of the secondary tube with a closure to prevent contamination, evaporation or loss of the sample.

Current closures for secondary tubes include plastic caps that snap over or into the secondary tube or cork or rubber stoppers, wherein the stopper is solid and includes a plug portion that fits in the open end of the tube and an enlarged head portion used to remove the closure from the tube using a two-handed method. Such closures provide means for sealing the open end of the tube, but are difficult to remove with two hands and impossible to remove using only one hand. This presents a problem, since the closure must be removed from the tube and discarded prior to placing the tube in a chemical analyzer due to the inability of most sample probes to penetrate any solid closure material. In view of the above, it is desirable to have a closure that can be easily removed from the tube or a closure that can remain on the tube and be easily opened and closed many times for manual sample access and/or during dire sampling by a chemical analyzer.

SUMMARY OF INVENTION

The present invention overcomes the problems identified in the background material by providing a closure for primary or secondary fluid collection, transport or storage containers or tubes for body fluids that can easily be opened and closed multiple times.

A preferred embodiment of a closure according to the present invention includes a bail and socket closure to be used to resealably close a specimen container or s tube used in a laboratory or other clinical environment. In one embodiment, the ball and socket closure is snap-fitted into a tube. The ball has a tab extending therefrom that is pushed by a user approximately 90 degrees to rotate the ball within the socket to a position wherein a passageway through the ball aligns with the opening of the tube and provides access through the closure to the inside of the tube. When the tab is pushed 90 degrees in the opposite direction the ball rotates to close the passageway and seal the open end of the tube for storage to avoid evaporation and for possible access or retest at a later date.

An object of the ball and socket closure of the present invention is to provide dirt access to the tube such that a transfer pipette or an analyzer sample probe can access the fluid contents of the tube without the probe contacting the inner surface of the tube or the closure itself. This structure prevents contact or contamination of the probe while maintaining a one handed closure operation. The tab on the ball provides for an easy opening and closing operation with one hand during use which is also a major ergonomic and workflow improvement over existing closures and tubes.

Another object of the present invention is to provide a closure having an outer diameter that is no larger than the outer diameter of a current primary specimen collection container with closure (i.e., the VACUTAINER® SST® Brand Tube sold by Becton Dickinson and Company) so that the entire closure and tube assembly can be loaded into conventional analyzer racks, carousels or holders without removing the closure from the tube. Since the closure does not need to be removed from the tube, risk of loss or accidental contamination is minimized.

In addition, the ability to use only one closure through multiple samplings rather than replacement of stoppers multiple times reduces cost for the user.

In addition, the closure of the present invention is dimensioned to develop a liquid seal that prevents any liquid from leaking out of the tube through or past the ball and socket closure when it is in the closed position.

These and other aspects, features and advantages of the present invention will become apparent from the following detailed description taken in conjunction with the accompanying drawings.

DETAILED DESCRIPTION

Figure 1:
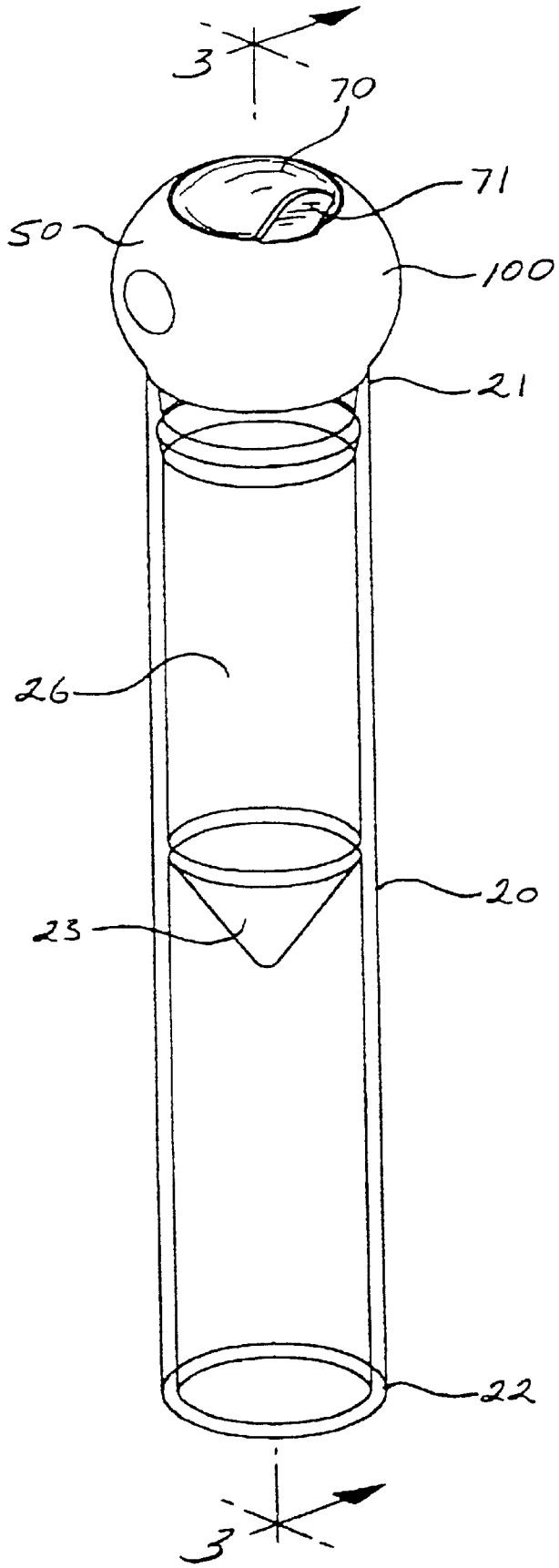
FIG. 1 is a perspective view of a ball and socket closure according to the present invention assembled with a tube, with the closure in a closed position.

FIG. 1 is a perspective view of a closure 100 according to the present invention assembled with a tube 20, with closure 100 in a closed position. Tube 20 includes an open top end 21 and an open bottom end 22 with an optional false conical bottom 23 located between top end 21 and bottom end 22. False conical bottom 23 provides tube 20 with an upper chamber 26 for holding small volumes of liquid. This type of structure allows for easy access to liquid in chamber 26 when utilizing a manual transfer pipette or an automated sample probe from a clinical analyzer. By using false conical bottom 23 the pipette or probe does not need to travel the full length of tube 20 to access the liquid therein.

Closure 100 is inserted and snap-fit into open top end 21 of tube 20 and is made of two parts: a ball 70 and a socket 50. Ball 70 includes a passageway 73 extending theretrough that can be aligned with open top end 21 to provide access to tube 20 or can be moved out of alignment, i.e., by 90 degrees, to prevent access to and seal open top end 21. A tab 71 extends from ball 70 and is used to rotate ball 70 within socket 50 between a first closed position and a second open position. When tab 71 is in the position shown in FIG. 1, ball 70 is in the first closed position wherein passageway 73 is not aligned with open top end 21 and thereby closing closure 100. However, when tab 71 is in the position shown in FIG. 2, passageway 73 is aligned with open top end 21 and closure 100 is open. Of course, use of tab 71, in the present embodiment, is merely exemplary since a protrusion or other type of extension from ball 70 could be used to rotate ball 70.

Tab 71 on ball 70 allows for easy opening and closing of closure 100 with one hand during use, which is an improvement over existing closures and tubes. Existing devices require the operator to remove the closure, place it on the workbench, pour from the primary container into the secondary container and then replace the closure with the second hand. The present invention provides a closure and tube assembly that can be held in one hand while the thumb of that hand is used to open or close the closure. The second hand is then free to pour from the primary container, which clearly simplifies the process and minimizes the risk of loss or spillage of biological fluids. As will be seen and described further below, the open position of closure 100 is also unique since it and no other currently available closure allows access to the liquid or specimen within a tube without having to remove a cap or stopper or penetrate a septum, rubber stopper or membrane. In effect, the present invention provides a "zero penetration force" closure. This improved overall safety and ease of use is important since the nature of the biological specimen routinely handled in laboratories and clinical environments may be infectious.

Figure 2:
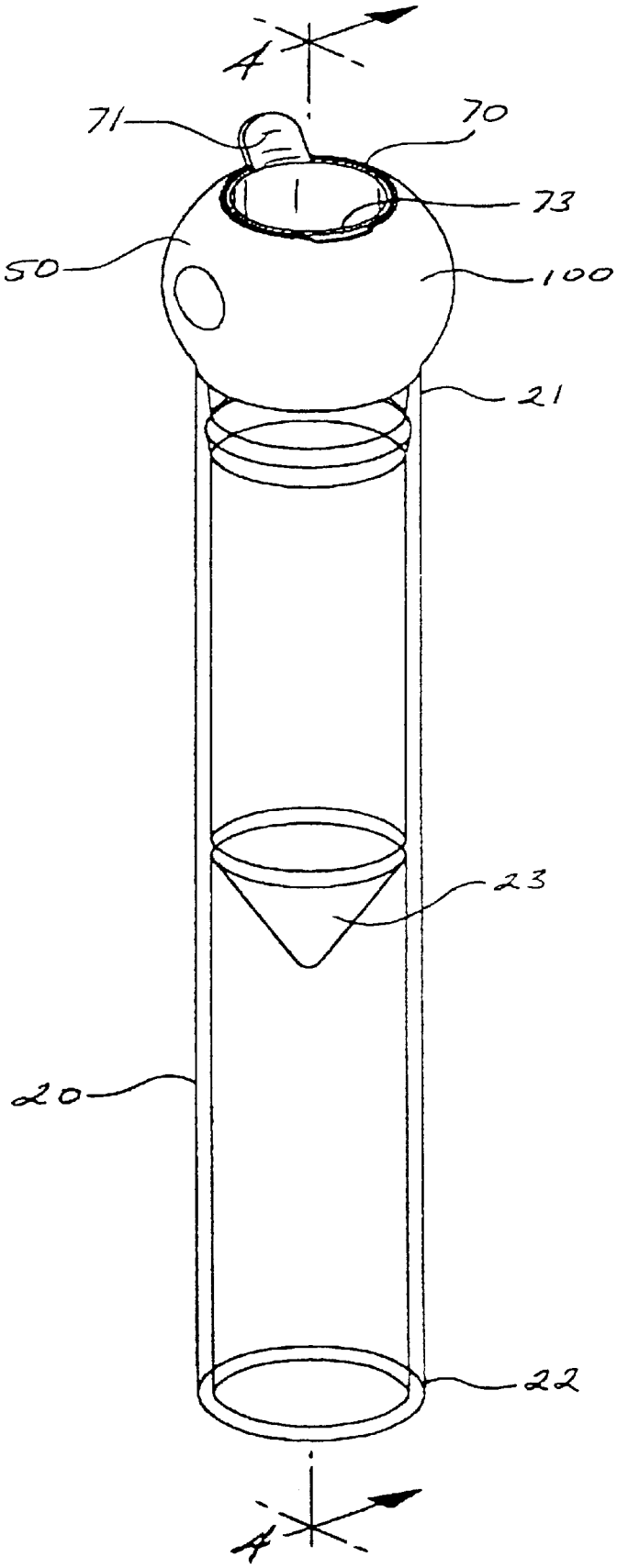
FIG. 2 is a perspective view of the ball and socket closure and tube assembly shown in FIG. 1, with the closure in an open position.
Figure 3:
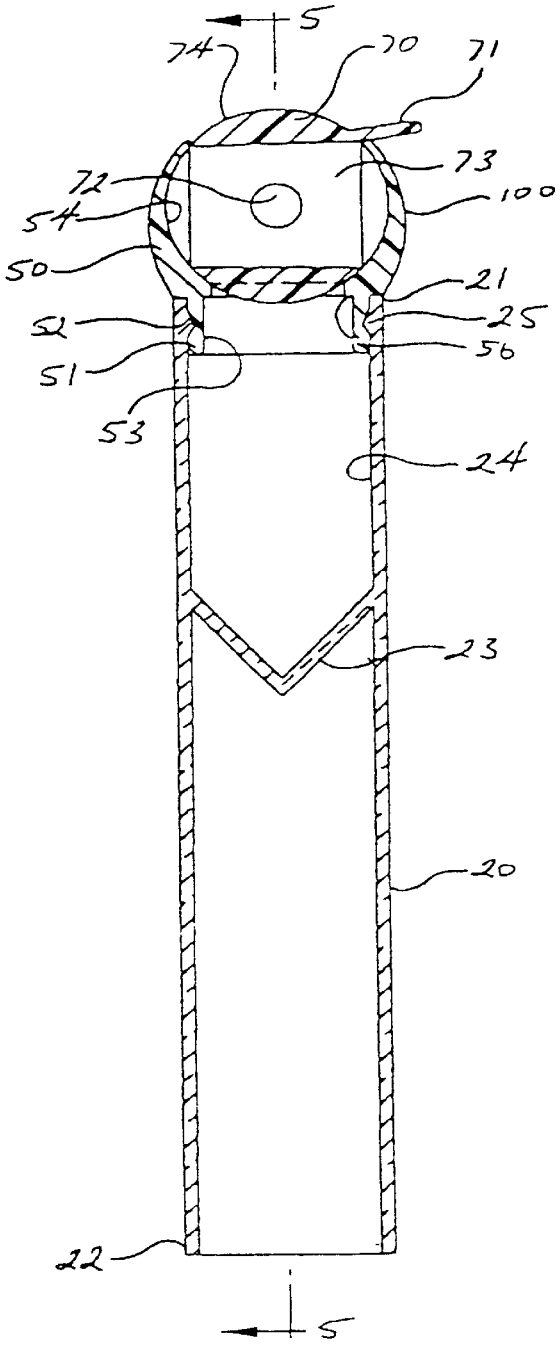
FIG. 3 is a cross-sectional view of the ball and socket closure and tube assembly shown in FIG. 1 along line 3—3.
Figure 4:
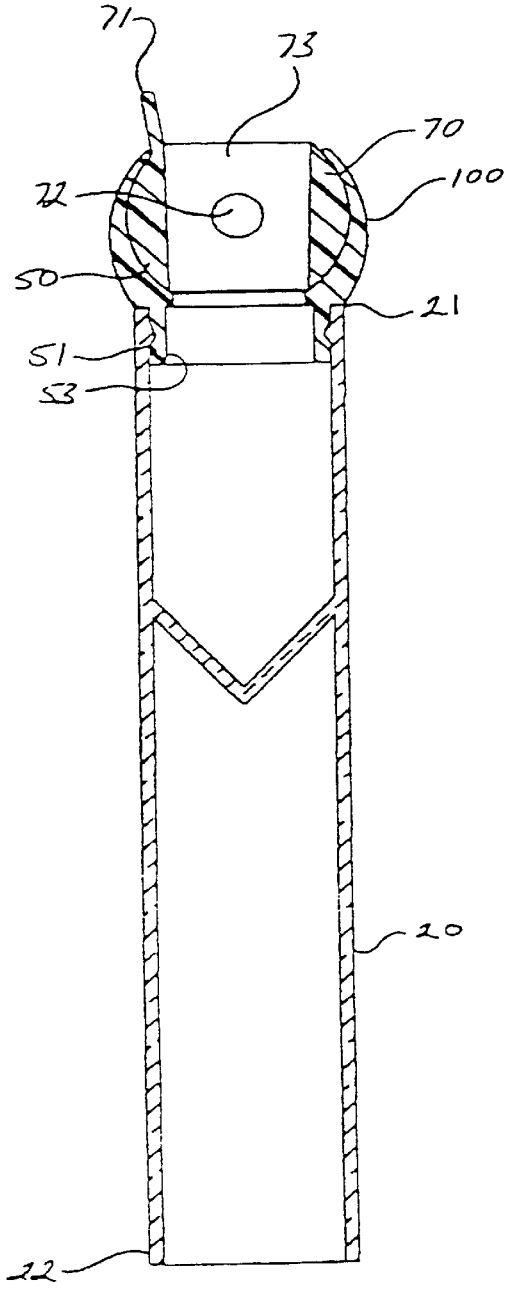
FIG. 4 is a cross-sectional view of the ball and socket closure and tube assembly shown in FIG. 2 along line 4—4.
Figure 7:
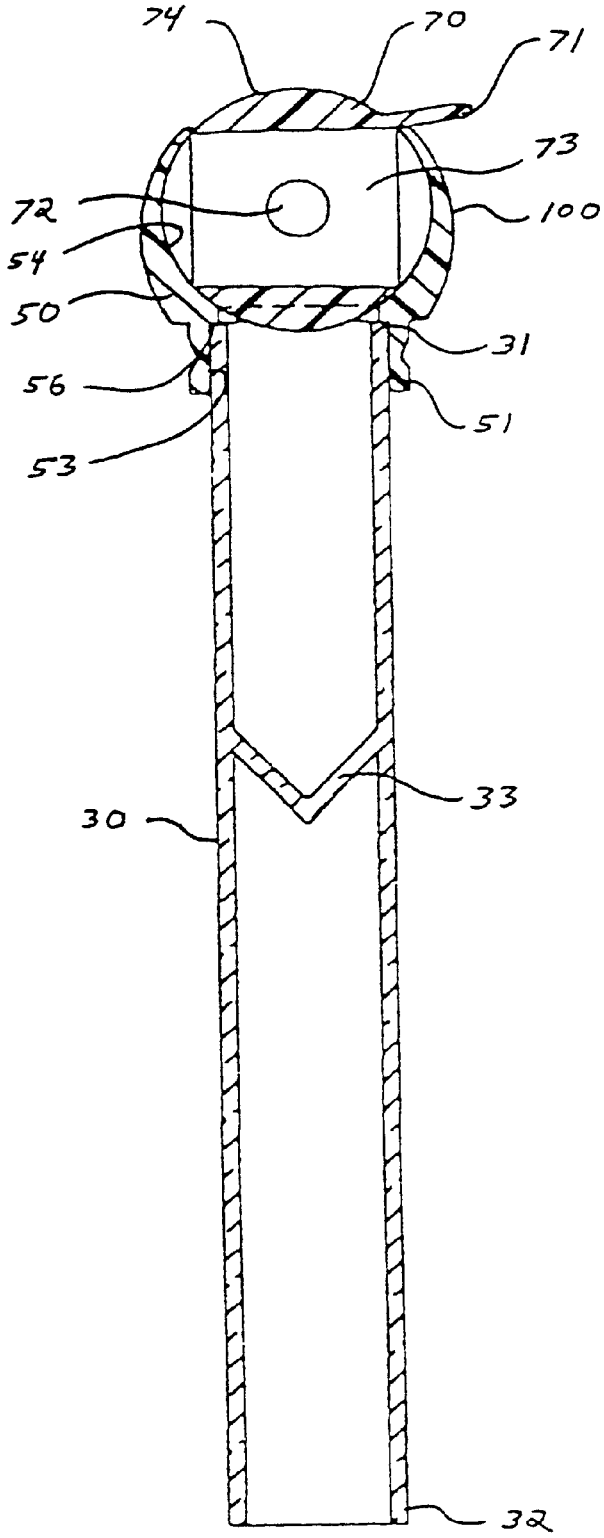
FIG. 7 is a cross-sectional view of the ball and socket closure shown in FIG. 3 mounted on a small diameter tube.

FIG. 3 is a cross-sectional view of closure 100 and tube 20, shown in FIG. 1, along line 3—3 and FIG. 4 is a cross-sectional view of closure 100 and tube 20, shown in FIG. 2, along line 4—4. As shown in FIGS. 3 and 4, ball 70 includes a pair of annular flat surfaces 72 that together with a pair of corresponding annular flat surfaces within socket 50 provides an axis about which ball 70 rotates within socket 50. Socket 50 also includes an annular plug portion 51 extending from a lower end of socket 50 that is received in open top end 21 of tube 20. Plug portion 51 also includes an annular groove 52 on its outer surface that forms a snap-fit with an annular protrusion 25 located on an inside wall 24 of tube 20 just within open top end 21. The ball and socket closure 100 is snap fit into the open top end 21 of tube 20 when annular plug portion 51 is inserted into open top end 21 and annular protrusion 25 is received within annular groove 52. Annular plug portion 51 includes an opening 53 therethrough with a shoulder 56 therein for optionally receiving the open end of a small diameter tube 30, as shown in FIG. 7.

Figure 5:
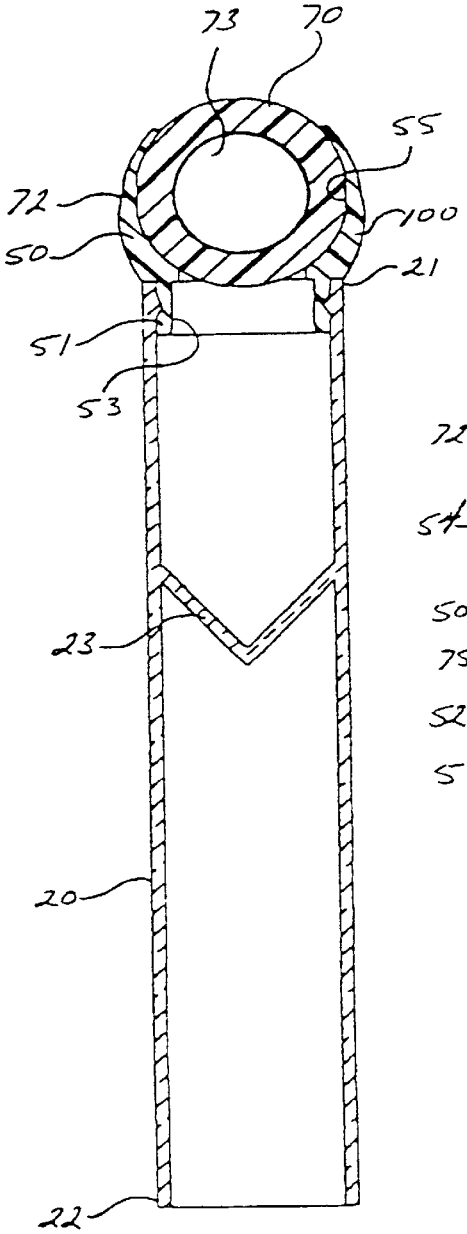
FIG. 5 is a cross-sectional view of the ball and socket closure and tube assembly shown in FIG. 3 along line 5—5.
Figure 6:
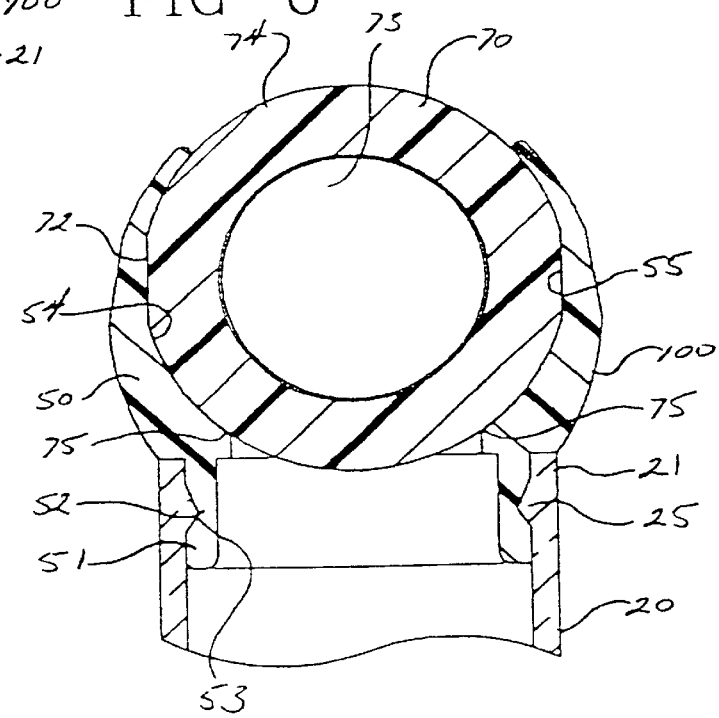
FIG. 6 is an enlarged cross-sectional view of the ball and socket closure shown in FIG. 5.

FIGS. 5 and 6 are cross-sectional views of closure 100 and tube 20, shown in FIG. 3, along line 5—5, and more clearly show the detail of the snap-fit arrangement between annular protrusion 25 on tube 20 and annular groove 52 on annular plug portion 51. In addition, FIG. 6 shows how outer surface 74 of ball 70 is dimensioned to fit within and interact with inner surface 54 of socket 50 to develop a liquid tight seal at location 75. The liquid tight seal at location 75 thereby prevents any liquid within tube 20 from leaking out of tube 20 through or past ball 70 and socket 50 when closure 100 is in the closed position shown in FIGS. 1, 3, 5 and 6. In addition, when closure 100 is in the closed position, passageway 73 is perpendicular to passageway 53 and open top end 21 which also prevents access to the inside of tube 20.

Alternatively when closure 100 is in the open position shown in FIGS. 2 and 4, passageway 73 is aligned with passageway 53 and open top end 21 thereby providing access to the inside of tube 20 and releasing the liquid tight seal at location 75. The internal diameter of passageway 73 and passageway 53 is preferably 10.5 millimeters when the closure is being used on a 16 millimeter primary or secondary tube. Of course, smaller passageways 25 and 73 can be used such as on tubes having smaller outer diameters. However, passageway 53 should at least have an internal diameter of approximately 1.0 millimeter to allow access to fluid through passageway 73 and 53 when the closure is used in combination with smaller diameter tubes or containers or in use with very small bore probes on needles. The preferred internal diameter for a 16 millimeter tube has therefore been selected to be large enough to accept commercially available specimen probes without the probe coming into contact with the interior surfaces of ball 70, socket 50 or tube 20. Therefore, the above-noted dimension provides a "zero penetration force" closure.

It is also important not to have too large of a passageway 73 and 53, since the outside diameter of closure 100 or socket 50 must not be too large. If the outside diameter of closure 100 or socket 50 is larger than the outside diameter of a standard primary blood collection tube and closure system, there is an increased risk that tube 20 and closure 100 will not properly fit or function in conventional chemistry analyzer specimen carriers. Therefore, it is preferable to have the outside diameter of socket 50 less than approximately 19.05 millimeters.

Closure 100 is easily moved from the closed position shown in FIG. 1 to the open position in FIG. 2 by pushing tab 71 to rotate ball 70 by 90 degrees and thereby align passageway 73 with passageway 53 and open top end 21. Likewise, when tab 71 is pushed in the opposite direction by 90 degrees ball 70 is rotated to move passageway 73 perpendicular to passageway 53 and close closure 100. By consistently assembling and orienting closure 100 during manufacturing tab 71 can be placed in a sample tube holder and automatically opened or closed using a robotic arm or device as in an automated laboratory environment.

FIG. 7 is a cross-sectional view of the ball and socket closure mounted on a small diameter tube 30. Tube 30 is smaller than tube 20 but still includes an open top end 31, an open bottom end 32 and an optional false conical bottom 23 located between top end 31 and bottom end 32. Open top end 31 is received and press-fit in opening 53 in annular plug portion 51 of socket 50 and abuts a shoulder 56 therein to provide a liquid tight seal between tube 30 and closure 100. Therefore, the structure of closure 100 provides a very functional "zero penetration force" closure that is flexible enough to be used on two different diameter tubes.

Figure 8:
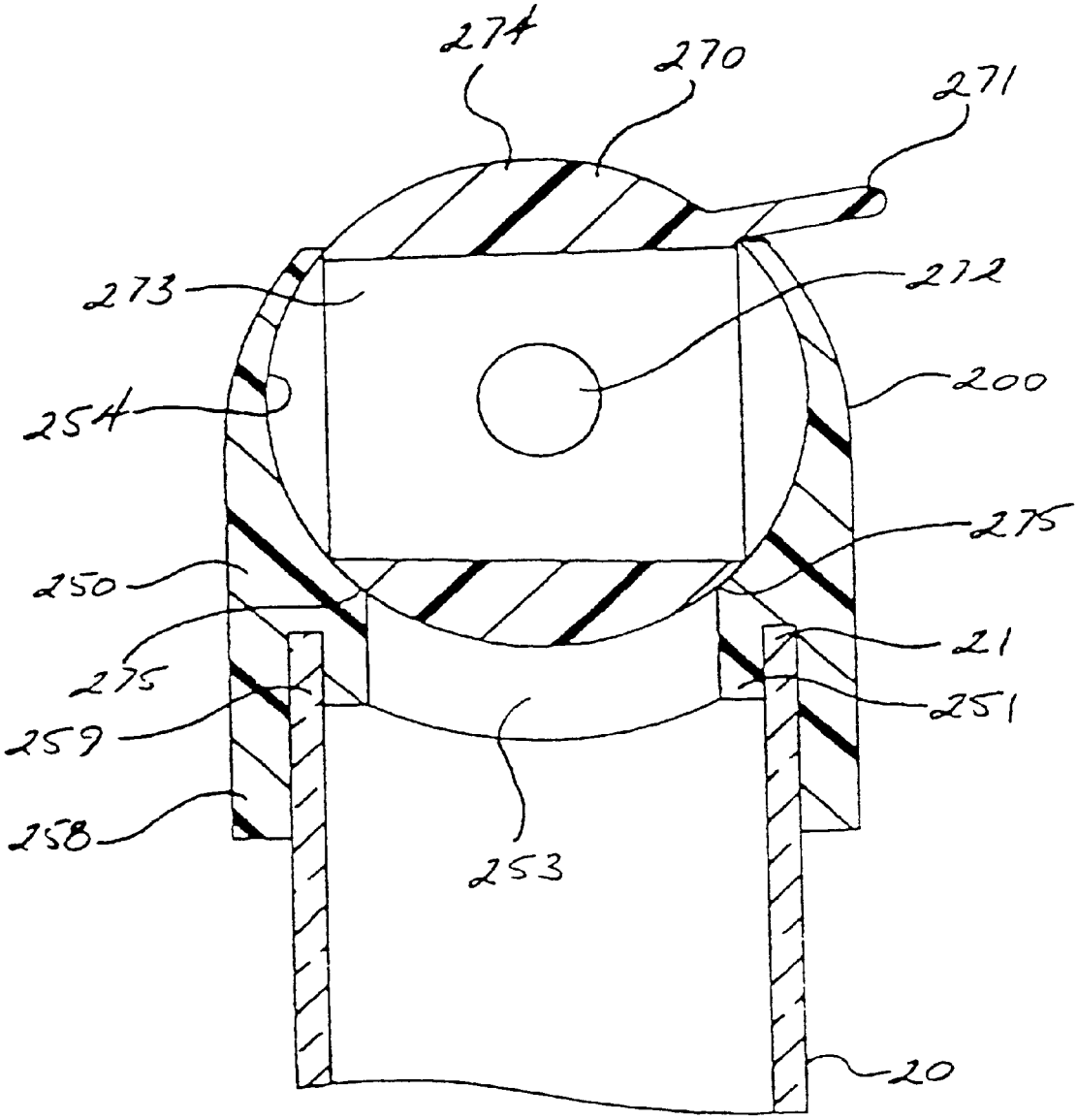
FIG. 8 is an enlarged cross-sectional view of another alternative ball and socket closure according to the present invention.

FIG. 8 is an enlarged cross-sectional view of an alternative ball and socket closure 200 according to the present invention. In that embodiment, closure 200 includes an annular receiving groove 259 in the lower end of socket 250 for receiving open top end 21 of tube 20, as opposed to using the snap-fit in closure 100 described above. Annular receiving groove 259 on the lower end of socket 250 is formed by an outer skirt 258 and an inner skirt 251. Outer skirt 258 extends down the outside of tube 20 and inner skirt 251 extends down the inside wall of tube 20, when open top end 21 is inserted into annular receiving groove 259.

Otherwise, closure 200 is very similar to closure 100 and includes a ball 270 having a passageway 273 therethrough that can be aligned with a passageway 253 in socket 250. Ball 270 can be moved from the closed position shown in FIG. 7 to an open position by pushing on a tab 271 extending from ball 270 and thereby rotating ball 270 by 90 degrees.

Ball 270 has an outer surface 274 that interacts with an inner surface 254 of socket 260 to provide a liquid tight seal at locations 275 and prevent liquid within container 20 from evaporating, being contaminated, or otherwise passing between socket 250 and ball 270 and out of tube 20. Ball 270 also includes a pair of flat surfaces (not shown) that interact with a pair of flat surfaces 272 on the inside surface 254 of socket 250 to define an axis about which ball 270 rotates within socket 250.

The above-described closure can be manufactured using many methods, but the best method is by separately molding the ball and socket and then assembling the ball into the socket. The socket is made from an elastomeric like material to allow the large diameter ball to be forced past the socket opening. The material used to make the socket can be. polyethylene or TPE, and the ball can be made of a harder material like styrene or polypropylene. It is also possible to use a "two-shot molding" approach that allows the ball to be molded first and then automatically mold another material over the ball to form the socket. The "two-shot molding" approach has the advantage of saving an assembly step. It is also possible to have the closure manufactured in three pieces, wherein a two-piece socket split in half to receive the ball is assembled around the ball into a single unit. However, of course, these manufacturing techniques and materials are merely exemplary, various other manufacturing methods and materials could also be used.

In the foregoing discussion, it is to be understood that the above-described embodiments of the present invention are simply illustrative of various features of closures for a body fluid collection, transport or storage containers. Other suitable variations, modifications and combinations of these features could be made to or used in these embodiments and still remain within the scope of the present invention.

What is claimed is:

1. A closure for sealing an open end of a specimen collection tube comprising:

a socket;

a ball rotatable mounted within said socket for movement between an open position and a closed position; and means for mounting said closure on the open end of the specimen collection tube comprising an annular receiving groove including an outer skirt and an inner skirt extending from a lower end of said socket that receives the open end of the specimen collection tube said outer skirt extending about an outside surface of the open end of the specimen collection tube and said inner skirt extending about an inside surface of the specimen collection tube, wherein said inner skirt and said outer skirt are parallel.

2. A closure of claim 1, wherein said outer skirt has a length which is greater than the length of said inner skirt.

* * * * *

UNITED STATES PATENT AND TRADEMARK OFFICE

CERTIFICATE OF CORRECTION

PATENT NO. : 6,705,482 B2 
DATED : March 16, 2004
INVENTOR(S) : Steven Robert Savitz and Gary S. Grant It is certified that error appears in the above-identified patent and that said Letters Patent is hereby corrected as shown below:

Column 1,
Line 18, delete "...doctor, phiebotomist or…" and insert -- ...doctor, phlebotomist or… --.
Line 61, delete "...includes a bail and a socket…" and insert -- ...includes a ball and socket… --.
Line 62, delete "...container or s tube…" and insert -- ...container or tube… --.

Column 3,
Line 12, delete "...extending theretrough…:" and insert -- ...extending therethrough… --.

Column 5,
Lines 33-34, delete "...socket can be. polyethylene…" and insert -- ...socket can be polyethylene… --.

Column 6,
Line 21, delete "a ball rotatable mounted…" and insert -- a ball rotatably mounted… --.

Signed and Sealed this

Twenty-fifth Day of May, 2004

JON W. DUDAS
*Acting Director of the United States Patent and Trademark Office*